US007565975B2

(12) United States Patent
Baker et al.

(10) Patent No.: US 7,565,975 B2
(45) **Date of Patent: *Jul. 28, 2009**

(54) MAIL FLAT ASSEMBLY FOR AUTOMATED PROCESSING AND METHOD OF DISTRIBUTING PROMOTIONAL ITEMS USING SAME

(75) Inventors: Ronald Baker, Middle Grove, NY (US); Steven J. Galarneau, Amsterdam, NY (US); Gary S. Farrell, Wyoming, MN (US); Paul E. Griffith, Lino Lakes, MN (US); Charles E. Wood, Eden Prairie, MN (US)

(73) Assignee: Holland USA, Inc., North Mankato, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/198,789

(22) Filed: Aug. 26, 2008

(65) Prior Publication Data

US 2008/0302698 A1 Dec. 11, 2008

Related U.S. Application Data

(63) Continuation of application No. 12/044,495, filed on Mar. 7, 2008.

(60) Provisional application No. 60/905,569, filed on Mar. 7, 2007.

(51) Int. Cl.
*B65D 73/00* (2006.01)
*B65D 1/34* (2006.01)

(52) U.S. Cl. ..... 206/461; 206/538; 206/371; 206/497

(58) Field of Classification Search ..... 206/461, 206/531, 497, 214, 828, 756, 232, 703, 528, 206/532, 538, 466, 471, 589, 371, 224, 564; 229/92, 87.02, 87.11, 87.01, 87.03, 87.5, 229/407

See application file for complete search history.

(56) References Cited

U.S. PATENT DOCUMENTS 1,744,388 A * 1/1930 Johnson ..... 206/214

(Continued)

FOREIGN PATENT DOCUMENTS

KR 10-0196451 6/1999

(Continued)

OTHER PUBLICATIONS

*Mailing Standards of the United States Postal Service, Domestic Mail Manual*; chapter 300, § 301, Aug. 14, 2008.

*Primary Examiner*—Mickey Yu
*Assistant Examiner*—Steven A. Reynolds
(74) *Attorney, Agent, or Firm*—Patterson, Thuente, Skaar & Christensen, P.A.

(57) ABSTRACT

A flexible, uniform mail package for use with automated mailing procedures and a method of distributing advertising and promotional items. A mail package includes a plastic tray with at least one well for containing and securing an article, such as a pen or a key tag, within the mail package. The mail package meets current and proposed USPS uniformity and flexibility standards for automated handling of the mail packages, and is capable of being processed, without issue, using automatic equipment thereby reducing postage costs compared to non-flat machinable mail pieces.

9 Claims, 6 Drawing Sheets

U.S. PATENT DOCUMENTS

| | | | | | |
|---|---|---|---|---|---|
| 2,757,793 | A | * | 8/1956 | Deitz | 206/462 |
| 3,127,010 | A | * | 3/1964 | Capezzuto | 206/45.2 |
| 3,212,907 | A | * | 10/1965 | Caprioli | 426/119 |
| 3,341,006 | A | * | 9/1967 | Bindler | 206/461 |
| 3,861,529 | A | | 1/1975 | Coleman | |
| 4,266,666 | A | * | 5/1981 | Kuchenbecker | 206/461 |
| 4,444,310 | A | * | 4/1984 | Odell | 206/366 |
| 4,535,890 | A | * | 8/1985 | Artusi | 206/530 |
| 4,711,348 | A | | 12/1987 | Schluger | |
| 4,733,775 | A | | 3/1988 | Fireman | |
| 4,838,425 | A | * | 6/1989 | O'Brien et al. | 206/531 |
| 4,911,304 | A | * | 3/1990 | Bunin | 206/531 |
| 5,052,560 | A | | 10/1991 | Stringham | |
| 5,080,225 | A | | 1/1992 | Russo et al. | |
| 5,160,022 | A | | 11/1992 | Mennella | |
| 5,186,499 | A | * | 2/1993 | Mason | 283/81 |
| 5,213,214 | A | | 5/1993 | Stringham | |
| 5,607,101 | A | | 3/1997 | Saito | |
| 5,653,335 | A | | 8/1997 | Bauer et al. | |
| 5,988,382 | A | | 11/1999 | Ritchie et al. | |
| 6,010,462 | A | | 1/2000 | Stoermer, III | |
| 6,021,896 | A | | 2/2000 | Marshall | |
| 6,089,370 | A | | 7/2000 | Mughal | |
| 6,311,839 | B1 | | 11/2001 | Lo | |
| 6,484,875 | B1 | | 11/2002 | Brainerd et al. | |
| 6,631,801 | B2 | | 10/2003 | Boyd-Moss et al. | |
| 6,802,422 | B2 | | 10/2004 | Kalvelage et al. | |
| 7,097,035 | B2 | | 8/2006 | Agakanian | |
| D566,541 | S | | 4/2008 | Nanda | |
| 7,353,948 | B1 | | 4/2008 | McDonald | |
| 7,360,653 | B2 | | 4/2008 | Blake et al. | |
| 2006/0266672 | A1 | | 11/2006 | Young | |
| 2007/0209957 | A1 | | 9/2007 | Glenn et al. | |
| 2008/0245695 | A1 | | 10/2008 | Baker et al. | |
| 2008/0290144 | A1 | | 11/2008 | Makofsky | |
| 2008/0290145 | A1 | | 11/2008 | Makofsky et al. | |

FOREIGN PATENT DOCUMENTS

| | | |
|---|---|---|
| WO | WO 94/21530 | 9/1994 |

* cited by examiner

MAIL FLAT ASSEMBLY FOR AUTOMATED PROCESSING AND METHOD OF DISTRIBUTING PROMOTIONAL ITEMS USING SAME

RELATED APPLICATION

This application is a continuation application of U.S. patent application Ser. No. 12/044,495, filed Mar. 7, 2008, which claims the benefit of U.S. Provisional Application No. 60/905,569, filed Mar. 7, 2007, both of which are incorporated herein by reference in its entirety.

FIELD OF THE INVENTION

The present invention relates generally to mail packages. More particularly, the present invention is directed to a mail flat assembly having a flexible tray for retaining and orienting a promotional item relative to the tray within the mail flat assembly, while providing flexibility and uniformity to the mail flat assembly. The mail flat assembly of the present invention is designed to meet current and proposed United States Post Office flexibility and uniformity standards for automated processing and is capable of being processed by automated equipment thereby qualifying for corresponding automated flat postage rates.

BACKGROUND OF THE INVENTION

It is common practice for businesses to mail material, such as advertising material and literature, to current and prospective customers in the form of a mail package, such as a flat. Often times, the material will include product samples and/or promotional items such as, for example, pens, key tags, calendars, and other such items along with any literature. Historically in the United States, the mailing standard for these types of packages has been a non-automated flat postage rate, for example, $0.345 per piece. However, the United States Postal Service (USPS) has created a new category called Not Flat-machinable (NFM) which basically states that a mail piece that is too rigid, too thick, and/or non-uniform, based on flexibility and uniformity standards, cannot be processed as a flat and will incur significantly higher postage rates. See 39 C.F.R. § 111.1, and *Mailing Standards of the United States Postal Service, Domestic Mail Manual* at chapter 300 (Commercial Flats), § 301 (Physical Standards) (last updated Aug. 14, 2008) (previously set forth in § 101 (Physical Standards)), all of which are incorporated herein by reference in their entirety. The higher postage rates can be as much as two or three times or more than the non-automated flat rate. The added cost for mailing NFM packages poses a significant cost burden to the mailing of product samples and promotional items.

Often times, a mail package as described above, is categorized within the USPS as a "flat." A flat, as commonly known in the postal processing industry, is a large envelope, newsletter, or magazine. To be designated a "flat" in the USPS, a mail piece must have at least one dimension that is greater than six and one-eighth inches high, eleven and one-half inches long, or one-quarter inch thick, with maximum dimensions of twelve inches high, fifteen inches long, and three-quarters inches thick, wherein the length is the dimension parallel to the address as read, and the height is the dimension perpendicular to the length. The maximum weight can range from about thirteen ounces to about fifteen pounds depending on the mail class used, i.e. first-class mail (thirteen ounces), standard mail (less than sixteen ounces), and bound printed matter (fifteen pounds). The physical standards for qualification as a flat are attached as Appendix A, incorporated herein in its entirety by reference.

The mailing standards are to encourage mail preparation that is compatible with improved processing capabilities, such as increased automation of postal processing. Under the NFM category, standard mail pieces with parcel-like characteristics, including rigid pieces, are presorted, entered, and processed as parcels, resulting in significantly higher postage costs.

In particular to flats, the mail standards require that flats must be rectangular, flexible, and uniformly thick within a specified variance to accommodate automated processing equipment. Such requirements are implemented by the above-referenced standards for flexibility and uniformity. As previously mentioned, an excerpt from the standards are included in Appendix A and can also be found at http://pe.usps.gov/text/dmm300/301.htm, which are incorporated herein in their entirety by reference. For example, to pass the flexibility test, the mail package is placed halfway off the edge of a flat surface such that the length is parallel to the edge of a flat surface. Using constant, steady pressure, the mail package is bent at a point one inch from the outer edge, in the center of its length. The mail package is flexible, according to the standards, if it can bend at least one inch vertically without being damaged. If the mail package does not contain a rigid insert, no further testing is required. If the mail package does contain a rigid insert, then the mail package is placed with its length perpendicular to the edge of the flat surface so that the mail package extends five inches off the surface if it is ten inches or longer, or one-half of its length if it is less than ten inches long. Using constant steady pressure, the mail package is bent at a point one inch from the outer edge, in the center of the piece's width. The mail package is then turned around and the test is repeated. The mail package is flexible, according to the standards, if both ends can bend at least one inch vertically without being damaged if it is less than ten inches long, and at least two inches vertically without being damaged if it is ten inches or longer.

Flat-size mail packages must also meet a standard of uniformity to be processed at the lower rate. The mail packages must be uniformly thick so that any bumps, protrusions, or other irregularities do not cause more than one-fourth of an inch variance in thickness. In determining variance in thickness, the outside edges of a mail package (one inch from each edge) is excluded when the contents of the mail package do not extend into those edges. Also, the selvage of any polywrap covering is excluded from the determination. Mail packages containing non-paper contents must secure the non-paper contents to prevent shifting of more than two inches within the mail package if shifting would cause the package to be non-uniform in thickness or would result in the contents bursting out of the mail package.

In addition to meeting the above standards, the mail package must be capable of being readily processed by automated equipment.

Internationally, a flexible, uniform mail package is also desirable to reduce postage rates, minimize shifting of articles within the mail package, and/or to allow the mail package to be readily processed using automated equipment.

There remains a need for a mail piece or package that is capable of accommodating various articles, such as promotional items, pens, key tags, and the like, while meeting the USPS's flexibility and uniformity standards for automated postal processing, such that the mail package can be readily processed by automated equipment. Such a mail package could also be used internationally.

SUMMARY OF THE INVENTION

The present invention resolves many of the above-described deficiencies and drawbacks of current mail packages that qualify as NFM pieces. In particular, the invention is directed to packaging for mailing items that meets the USPS's flexibility and uniformity standards for automated postal processing and can be readily processed by automated equipment. The flexible, uniform mail package of the present invention can also be used in regions outside of the U.S. The invention is also directed to a method for mailing items, such as advertising or promotional items and literature and the like using such mail packages.

Various embodiments of the invention disclosed and described herein are directed to a flexible, uniform mail package that is capable of accommodating one or more articles or product samples, such as, for example, pens, key tags, and the like. The mail packages are of sufficient flexibility and uniformity to be processed automatically within the USPS or other mailing services such as Federal Express, USPS, DHL, postal services of various other countries, and the like, therefore qualifying for a lower postage rate than NFM pieces.

In one embodiment of the invention, a mail package comprises a flexible carrier, such as a flexible tray, with at least one retaining member or well adapted to receive an article, such as a promotional item, and a packaging assembly, such as a film or envelope that covers at least a portion of the carrier and the article. The mail package provides sufficient flexibility for automated processing such that the mail package can be flexed at a test point by the application of a downward force without meeting a failure condition. Such failure conditions can include, but are not limited to, plastic deformation, creasing, tearing, breaking, and combinations thereof and combinations thereof.

In another embodiment of the invention, a mail package comprises a flexible carrier with at least one retaining member adapted to receive an article, such as a promotional item, and a packaging assembly, such as a film or envelope that covers at least a portion of the carrier and the article. The mail package provides sufficient uniformity for automated processing such that a thickness at any point along the mail package has a variance of less than a predetermined amount. In one example embodiment of the invention, the variance in thickness cannot exceed about one-quarter of an inch.

In yet another embodiment of the invention, a method of distributing advertising and promotional items to current or prospective customers comprises providing a flexible carrier with at least one article secured to the carrier by a retaining member, providing literature with the flexible carrier, packaging at least a portion of the carrier, article, and literature to create a mail package, and mailing the mail package to the current or prospective customers. The mail package is adapted to be flexed at a test point by the application of a downward force without meeting a failure condition.

The above summary of the invention is not intended to describe each illustrated embodiment or every implementation of the present invention. The figures and the detailed description that follow more particularly exemplify these embodiments.

DETAILED DESCRIPTION OF THE DRAWINGS

The mail package of the present invention accommodates the mailing of an item, such as an advertising item, promotional item or product sample, and is adapted for use in automated mailing procedures. Automated mailing procedures can include, for example, rollers, nips, sorting machines, conveyors, robotics, marking machines, channeling systems, and the like which often times include S-shaped pathways requiring significant deflection of envelopes and packages. The invention can be more readily understood by reference to FIGS. 1-7 and the following description. While the invention is not necessarily limited to such an application, the invention will be better appreciated using a discussion of exemplary embodiments in specific contexts.

Figure 1:
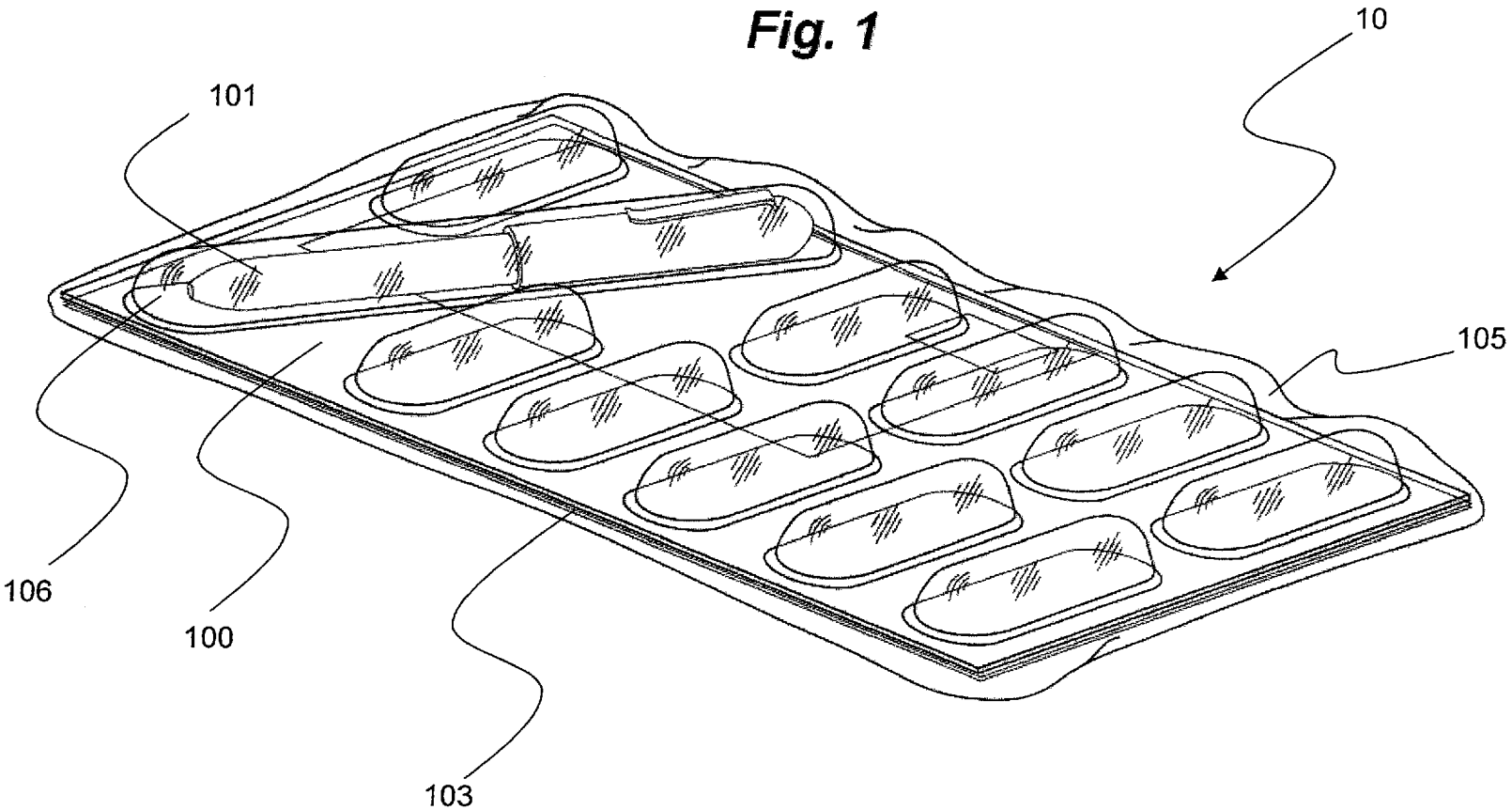
FIG. 1 is a top view of a mail package according to one embodiment of the invention.
Figure 6:
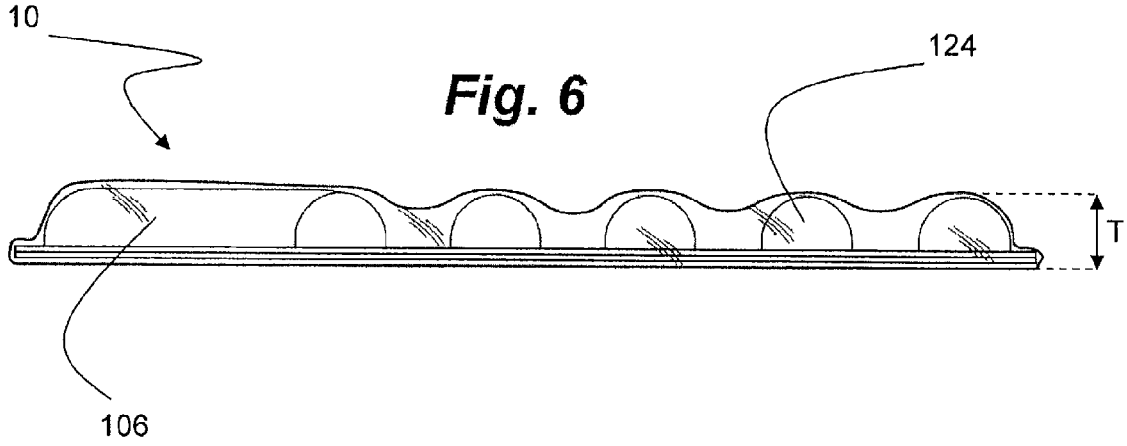
FIG. 6 is a side view of the mail package of FIG. 1.

In one embodiment of the invention, as depicted in FIG. 1, a mail package 10 can comprise a carrier 100 capable of retaining an article 101, such as a promotional item and/or product sample, one or more optional pieces of literature 103, and a packaging means 105 covering at least a portion of carrier 100 and the optional pieces of literature 103. Further, carrier 100 can comprise at least one retaining means 106 for retaining article 101 at a location on carrier 100 to minimize shifting of article 101 during handling. Mail package 10 has a thickness "T" that is substantially uniform about mail package 10, as depicted in FIG. 6.

Referring generally to FIGS. 2-5, and 7A-7C a carrier 100 for a mail package is used for mailing articles 101 such as, for example, advertising items, promotional items, product samples, pens, key tags, calendars, key chains, CDs, DVDs, USB flash drives, and the like. Carrier 100 can comprise a flexible material such as, for example, plastic, foam, cardboard, paper, inflatable material such as bubble wrap, other flexible materials, or combinations thereof.

Figure 2:
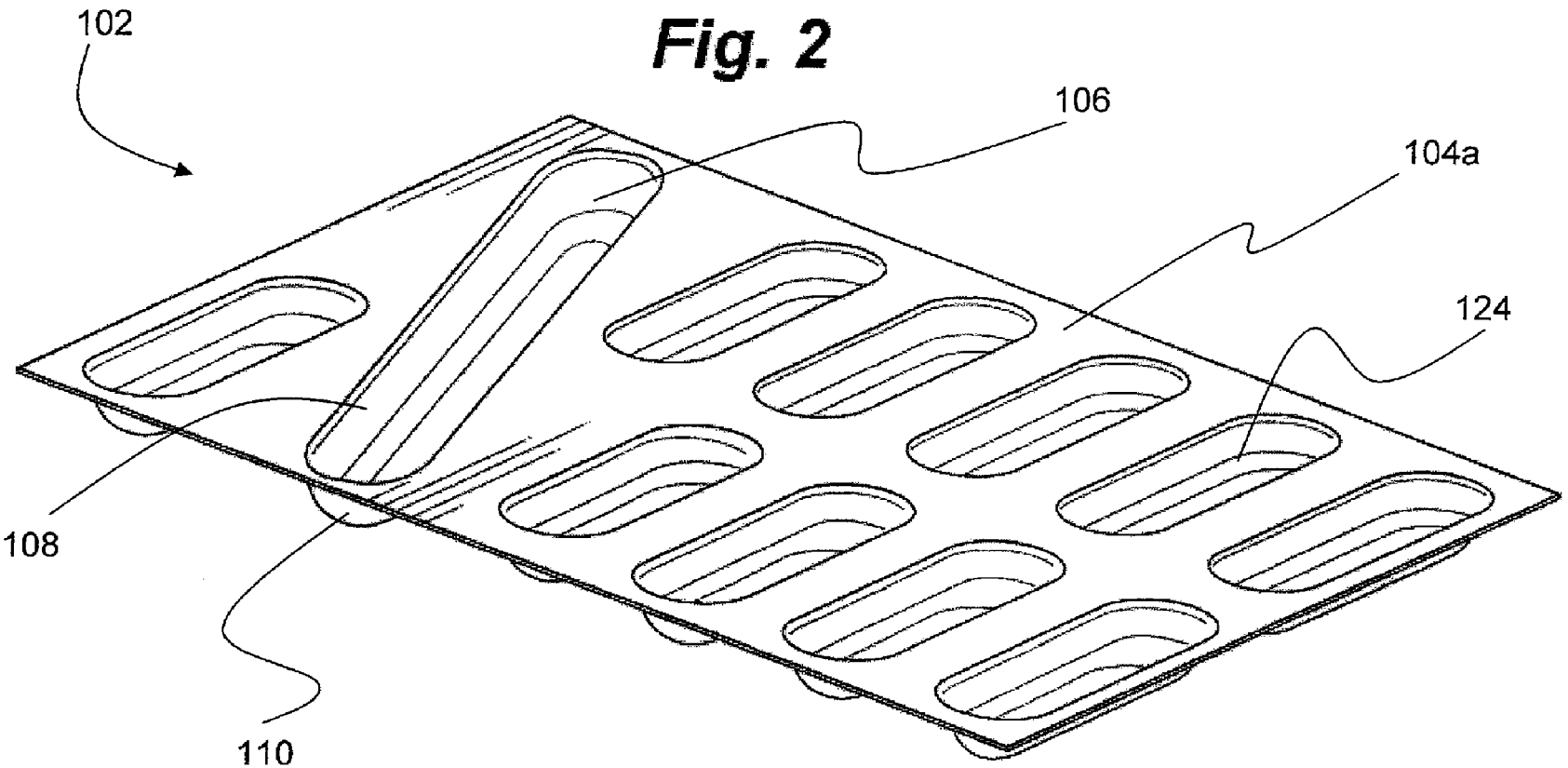
FIG. 2 is a perspective view of a carrier for a mail package according to one embodiment of the invention.
Figure 3:
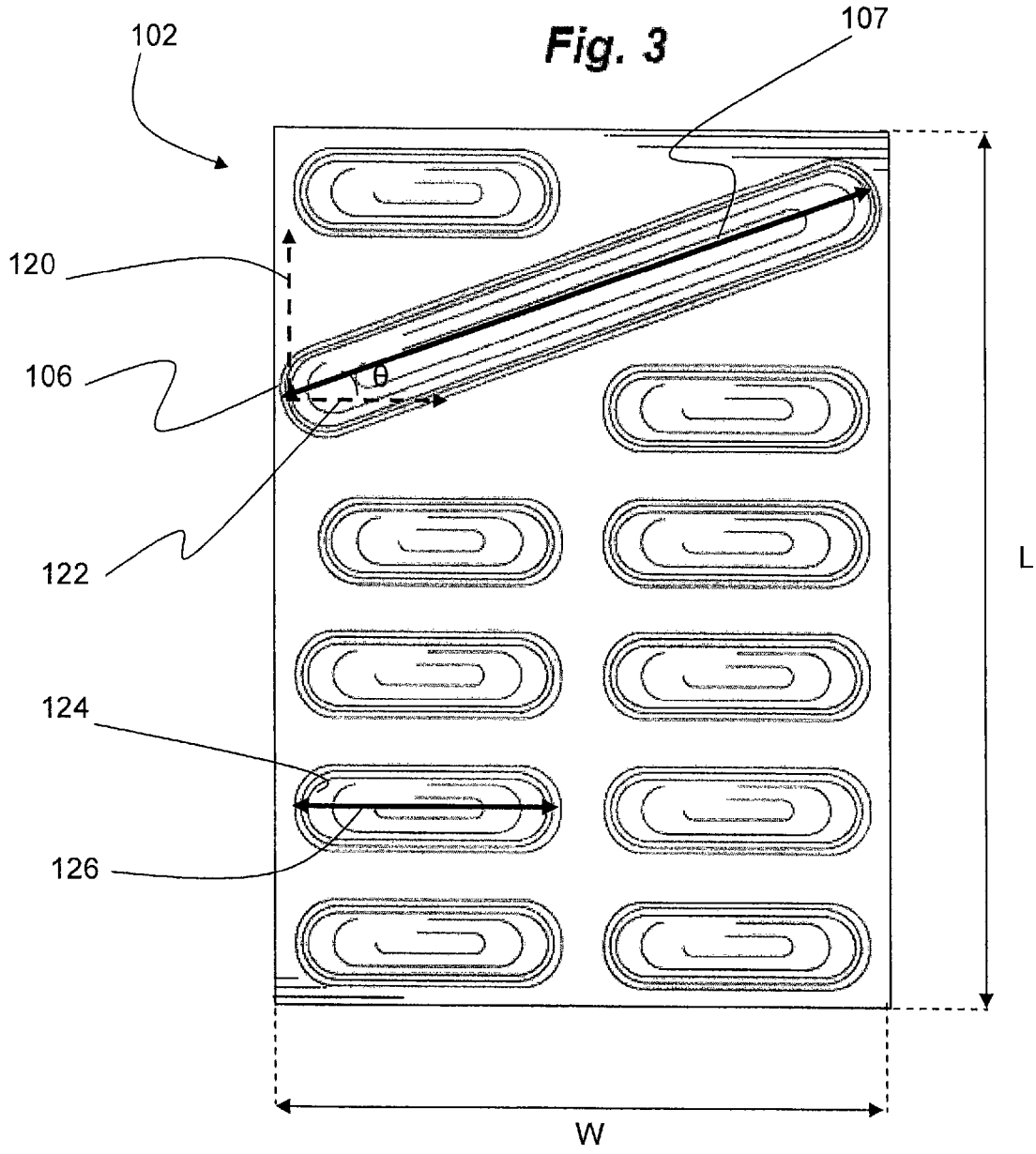
FIG. 3 is a top view of the carrier of FIG. 2.
Figure 4:
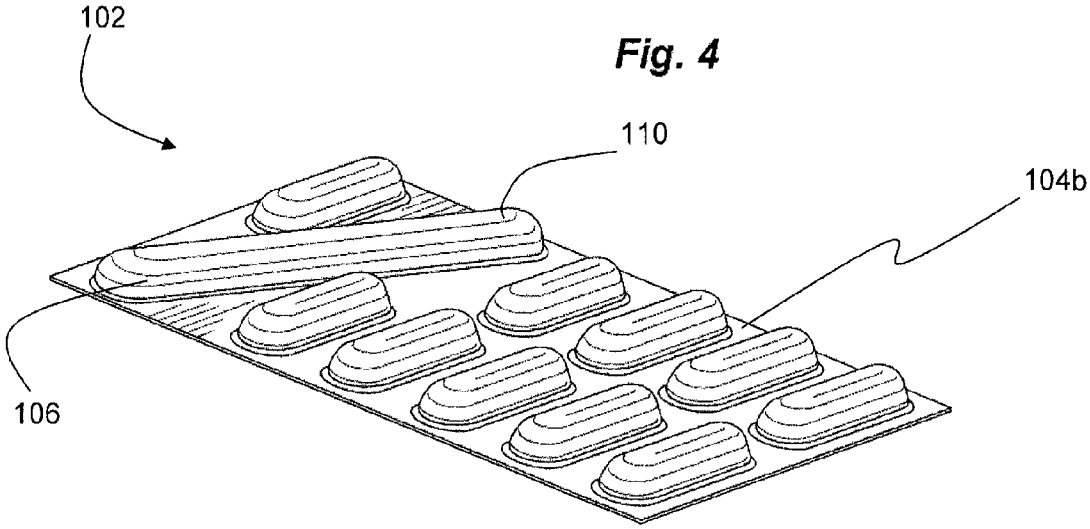
FIG. 4 is a bottom, perspective view of the carrier of FIG. 2.
Figure 5:
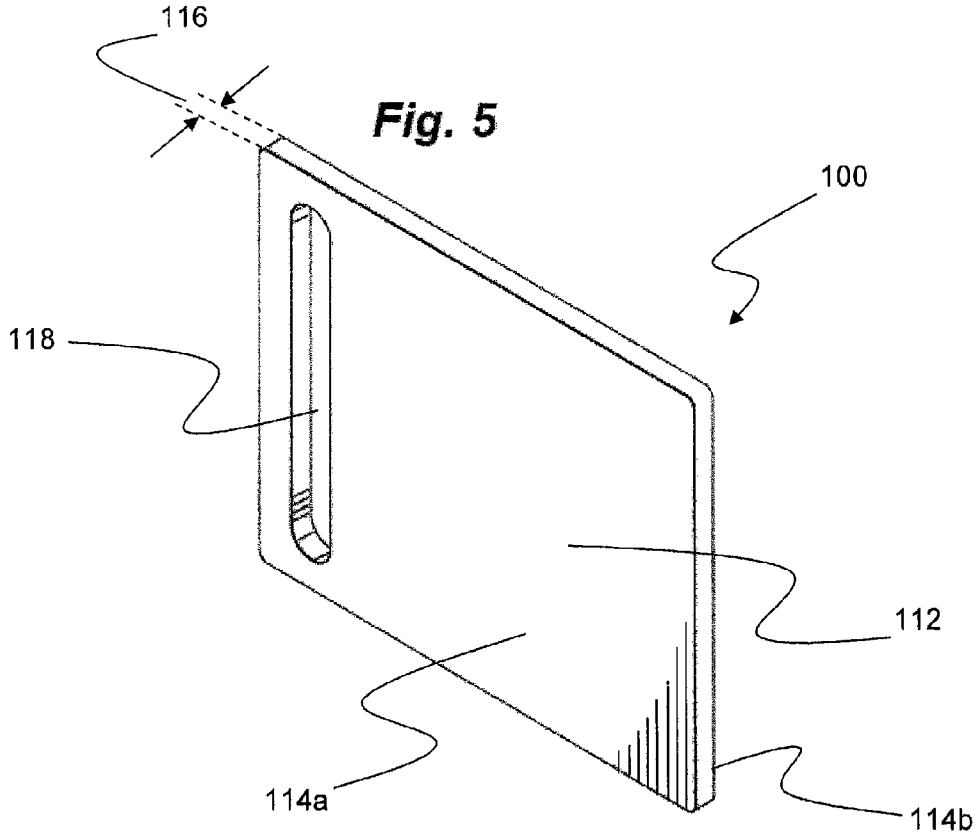
FIG. 5 is a perspective view of a foam carrier for a mail package according to one embodiment of the present invention.

In one embodiment of the invention, referring specifically to FIGS. 2-4, carrier 100 can comprise a flexible plastic tray 102 with a first major surface 104*a* and a non-planar second major surface 104*b*. In one embodiment of the invention, first major surface 104*a* is generally planar. Tray 102 can be formed by thermoforming, such as injection molding, blow molding, vacuum-formed, pressure-formed, and other processes known to one skilled in the art for shaping plastic articles. Preferably, the plastic material is lightweight, recyclable, inexpensive, and/or markable, i.e. it can be embossed, laser marked, or printed on with relative ease. Tray 102 can further comprise an optional coating and/or treatment covering at least a portion of tray 102. Such coatings and treatments can include primers, sealants, corona treatment, radiation curable ink, such as UV-curable or e-beam curable ink, adhesives, and combinations thereof. Suitable flexible plastics can include polypropylene, polyethylene, polystyrene, polyvinylchloride, and other plastics. Tray 102 is generally rectangular, having a length "L" and width "W". Tray 102 can be manufactured on demand, with relative ease and at high volumes.

Tray 102 can further comprise printed indicia 122, such as a company name, product name, supplier, website, telephone number, graphics, additional marketing materials, literature, and the like at any location on tray 102. Printed indicia 122 can be in the form of printing directly on tray 102, a label, engraving, lasered indicia, embossing, or any other suitable means known in the art.

Tray 102 can comprise at least one retaining means or retaining member 106, such as, for example, a well, receptacle, cavity, cutout, strap, mechanical fastener, adhesive, or any other suitable retaining means adapted for receiving and containing at least one article 101. In one embodiment of the invention, as depicted in FIGS. 1-4, retaining means 106 comprises an oblong well-type retaining member for receiving article 101, and a walled recess 108 extending from first major surface 104*a* for orienting article 101 relative to tray 102, and securing article 101 within mail package 10 to minimize shifting of article 101 within mail package 10 during handling and processing relative to tray 102. Well 106 can be of any suitable shape or dimension. For example, well 106 can taper from first surface 104*a* to floor 110, as depicted in FIGS. 1-4, or vice versa. Alternatively, well 106 can have substantially the same dimensions from first surface 104*a* along walled recess 108 to floor 110. Well 106 can have a perimeter cavity that is oblong or rectangular in shape with squared edges or rounded edges. Alternatively, well 106 can have a perimeter cavity that is square, oval, circular, or any of a variety of suitable shapes. Floor 110 can comprise a flat-bottom or rounded-bottom with either squared edges or rounded edges. In one embodiment of the invention, as shown in FIGS. 2-5 and 7A-7C, well 106 has an oblong perimeter cavity having rounded corners and floor 110 comprises a rounded bottom creating a half-tubular, or half-pipe type shape. In an alternative embodiment of the invention not shown, walled recess 108 and/or floor 110 can comprise surface features forming a non-planar surface along walled recess 108 and/or floor 110.

In one embodiment of the invention, referring to FIG. 3, opening 108 of well 106 comprises a perimeter or cross-section that is oblong in shape with rounded edges, having a longitudinal axis 107. Walled recess 108 also comprises an oblong cross-section. A length of longitudinal axis 107 can vary along the depth of walled recess 108, i.e. tapering, or can be of the same length along walled recess 108. Well 106 can comprise a shape suitable to receive and retain a promotional pen, for example, as shown in FIG. 1. Referring back to FIG. 3, well 106 is positioned on tray 102 at an angle θ relative to a y-component 120 substantially parallel to length L of tray 102, and an x-component 122 substantially parallel to width W of tray 102. The tangent of θ of well 106 is equal to a ratio of the y-component 120 to the x-component 122. In one embodiment, well 106 is oriented in such a way that when θ=0, longitudinal axis 107 of well 106 is substantially parallel to x-component 120, and longitudinal axis 107 is equal to or less than width W of tray 102, and when θ=90°, longitudinal axis 107 is substantially parallel to y-component 122, and longitudinal axis 107 is equal to or less than one-half of the length of the tray.

In an alternative embodiment of the invention not shown, well 106 is a suitable shape, such as a square, to receive a DVD or CD with or without its case. A well can comprise, for example, a square perimeter with sufficient dimensions to secure the CD or DVD within mail package 10 such that the CD or DVD does not shift more than two inches relative to the tray. Further, the dimensions of the square well should be sufficient such that mail package 10 exhibits acceptable flexibility with regards to the USPS standards in Appendix B. For example, any dimension, such as the side or the diagonal, when oriented substantially parallel to the length of the tray, should be of sufficient length to retain the CD or DVD securely within tray 102, while not allowing the CD or DVD to extend over one-half of the length L of tray 102, and optionally not over one-half of the width W of tray 102.

In another alternative embodiment not shown, the perimeter cavity is circular or oval in shape to receive, for example, a CD or DVD with or without its case. In such case, a diameter in the case of a circle, or a major axis in the case of an oval, is of a sufficient length to retain the CD or DVD securely within tray 102, while not allowing the CD or DVD to extend over one-half of the length L of tray 102, and optionally not over one-half of the width W of tray 102.

In one embodiment of the invention, article 101 can be further secured within well 106 by using an adhesive, tape, binder, clip, hook and loop combinations, or other suitable attachment means.

Retaining means 106 acts to immobilize an article 101 within mail package 10 so that it is not free to move which can upset the automated processing of such packages, and/or damage or destroy article 101 or mail package 10. For example, retaining means 106 immobilizes article 101 within mail package 10 in conformance with the USPS uniformity standard, found in Appendix A. The standard states that "[i]f the contents are significantly smaller than the envelope, wrapper, or sleeve, mailers must secure those contents to prevent shifting of more than two inches within the mailpiece."

Tray 102 can comprise more than one retaining means 106. The one or more additional retaining means 124 can be of the same type, shape and/or dimensions or of a different type from retaining means 106, shape and/or dimensions to accommodate one or more different items. Suitable shapes include, but are not limited to, oblong shapes, rectangular, tubular, pyramidal, conical, cubic, and the like, as described with respect to retaining means 106 above. Multiple retaining means 124 can be oriented perpendicular to, parallel to, at an angle to, or any combination to the length "L" of tray 102 so long as the USPS uniformity and flexibility standards are met.

Further, the number and/or orientation of retaining means 124 can be changed to provide various degrees of flexibility and/or uniformity to tray 102. For example, a single well 106 can be used to accommodate a single article 101. However, it can be desirable to have multiple retaining means 124 to induce additional flexibility and/or uniformity in tray 102 by providing multiple flexing regions along tray 102 that do not contain an article. In one embodiment of the invention, as depicted in FIGS. 1-4, and 6, tray 102 comprises multiple wells 124 in addition to well 106. Wells 124 can flex, for example, at a center of well 124 parallel to longitudinal axis 126 to impart flexibility to tray 102. In one embodiment, each well 124 has a longitudinal axis 126. Each longitudinal axis 126 can be oriented substantially parallel to each and every other longitudinal axis 126 of wells 124 as depicted in the figures, or in an alternative embodiment, at different directions from one another (not shown). Further, longitudinal axis 126 of each well 124 can be parallel to, perpendicular to, or at any angle from longitudinal axis 107 of well 106. As described above, wells 124 can be substantially similar to, or different from the shape and dimensions of well 106. For example, as depicted in the figures, the length of longitudinal axis 126 of well 124 is less than the length of longitudinal axis 107 of well 106. The depth of each well 124 can be substantially similar to the depth of well 106 to impart uniformity to mail package 10, and walled recess of wells 124 and well 106 all extend inwardly from first surface 104*a* of tray 102. In an alternative embodiment, the depth of wells 124 can vary from one another, and/or from well 106. In yet another alternative embodiment, the walled recesses of wells 124 extend outwardly from first surface 104*a* of tray 102, whereas walled recess 108 of well 106 extends inwardly from first surface 104*a*, such that the total thickness of mail package 10 does not exceed the flat standards. The length of longitudinal axis 126 can vary among wells 124, or can be substantially similar among wells 124. In one particular embodiment of the invention, referring to FIGS. 1-4, and 6, wells 124 are substantially parallel to one another, and substantially parallel to width W of tray 102. Any combination of number of wells, well size, shape, and/or orientation with respect to well 106 and tray 102 is herein contemplated so long as the USPS flexibility and uniformity standards are met.

Figure 7C:
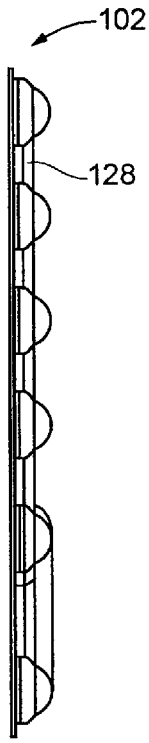
FIG. 7C is a side view of the carrier of FIG. 7A.
Figure 7A:
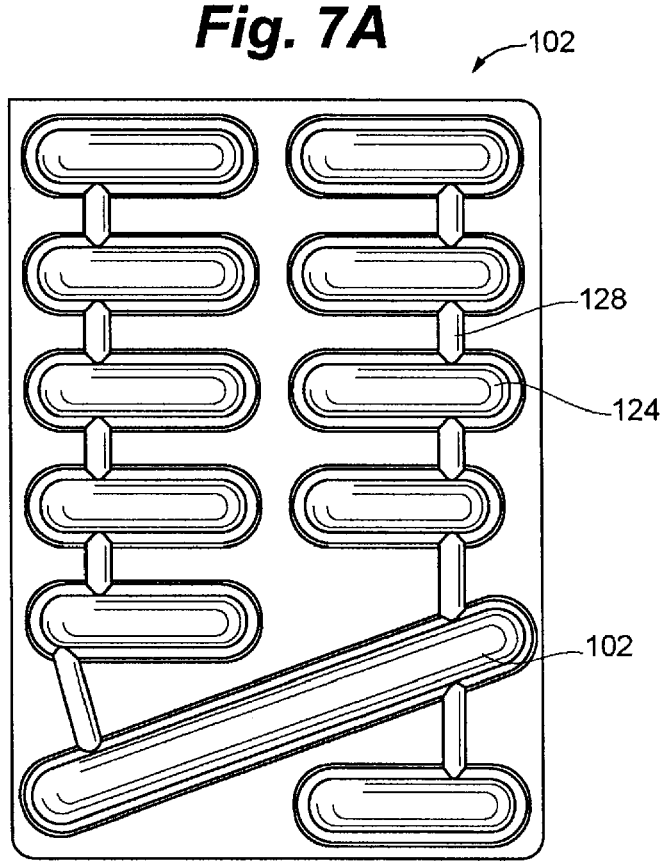
FIG. 7A is a bottom view of a carrier for a mail package according to one embodiment of the invention.
Figure 7B:
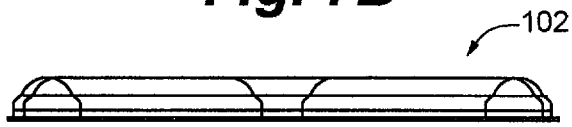
FIG. 7B is an end view of the carrier of FIG. 7A.

In an alternative embodiment of the invention, as depicted in FIGS. 7A-7C, bridges 128 are positioned to connect or bridge wells 124 to each other and to well 106, to impart structural integrity and uniformity to tray 102. It may be desirable to form tray 102 of less material such that tray 102 is thinner, and therefore less expensive. However, when using a thinner material, tray 102 can be too flexible, losing its rebound characteristic, which can cause curling of tray 102. Bridges 128 can aid in making tray 102 flexible enough to pass the standards, but rigid enough that it doesn't curl. Bridges 128 can also be formed of a sidewall extending, either inwardly or outwardly, from first surface 104*a*. Bridges 128 can be of any suitable shape, and can be positioned substantially perpendicular to, substantially parallel to or at an angle to longitudinal axis 107 of well 106, as well as to each other. One or more bridges 128 provide sufficient rigidity or structural integrity to tray 102, such that tray 102 can be made of less material or thinner, and therefore less expensive. In one embodiment of the invention, a thickness of tray 102 is about ten mils or less. In an alternative embodiment, tray 102 can also be greater than 10 mils, as long as the USPS flexibility standards are still met.

In an alternative embodiment of the invention, referring to FIG. 4, carrier 100 can comprise a foam carrier 112. Foam carrier 112 can comprise a generally planar first major surface 114*a* and second major surface 114*b*, with a thickness 116. At least one aperture 118, adapted for receiving and containing an article 101 extends through the entire thickness 116 of foam carrier 112 to form a retaining means 117, such as a cutout. The perimeter of aperture 118 can be any suitable shape, such as, for example, square, circle, oblong such as a rectangle or oval, and a variety of other shapes. Retaining means 117 can be formed by die cutting, laser cutting, manually cutting, shaped during the manufacturing of the foam, or other process known to one skilled in the art. In an alternative embodiment of the invention not depicted in the figures, aperture 118 does not extend in its entirety through first and second major surfaces, leaving a floor to create a well-type retaining means. Although foam carrier 112 can be generally rectangular in shape, in alternative embodiments, foam carrier 112 can comprise a functional item such as, for example, a mouse pad, beverage can insulator, cup coaster, and the like, that can be used post processing and mailing by the recipient.

To form a mail package 10 that meets USPS standards for uniformity and flexibility, and can be readily processed by automated equipment, at least a portion of carrier 100 and article 101 least one article 101 can be subsequently enclosed using packaging means 105. For example, carrier 100 can be wrapped, placed in or used in conjunction with an envelope, boxed, packaged, formed, or shaped to form mail package 10. In one embodiment of the invention, packaging means 105 comprises an envelope of adequate flat dimensions as described above and found in Appendix A. In an alternative embodiment, depicted in FIG. 1, packaging means 105 comprises a polywrap to enclose tray 102 with article 101. Other suitable packaging means can include boxes, paper, foil, and any of a variety of suitable packaging means. Packaging means 105 can be transparent, semi-transparent, opaque, or a combination thereof. Further, packaging means 105 can include printed indicia such as text, images, postage, and the like. The printed indicia can be printed directly onto packaging means 105, indirectly applied to, such as, for example, by labeling, or combinations thereof.

Optional literature, such as, for example, advertising literature, promotional literature, coupons, business cards, return envelopes, samples, letters, circulars, marketing material, order forms, surveys, questionnaires, additional items, and other such information and/or items can be added to the envelope. Further, a rigid or semi-rigid insert, such as, for example, cardboard or cardstock, can also be included to provide further article stability, and/or uniformity to mail package 10.

In another embodiment of the invention, the mail package can comprise a padded envelope in which at least one promotional item can be secured within at least one pocket integrated either within the padding of the envelope, or the envelope itself. Further, the padding can be part of the envelope itself, or a separate component, such as a filler, foam, stuffing, or the like. For example, a pocket may be integrated on a spine of a padded envelope. In yet another embodiment of the invention, carrier 100 can comprise at least one air pillows, similar to bubble wrap. The promotional item can be either secured on the outside of the pillows using tape, glue, or the like materials, or the item can be secured within one of the pillows. Typically, air pillows are made by unrolling a thin plastic sheet, blowing compressed air into a chamber, and sealing the sheet on either side to form a pillow. The plastic material, such as high density polyethylene, is inexpensive, recyclable, lightweight, and can be pre-printed with graphics and text.

In use, mail package 10 passes the USPS's flexibility and uniformity standards as set forth in Appendix A. Further, mail package 10 is capable of being processed by automated mailing equipment. As described above, such automated processing results in lower postage rates than NFM pieces. In other embodiments of the invention, mail package 10, or carrier 100 alone, can be used internationally in regions outside the United States, regardless of whether similar standards exist. Carrier 100 of the present invention provides flexibility and uniformity to a mail package 10 that is low in cost, and can be produced with relative ease anywhere in the world.

To pass the flexibility standard in the United States, the following test procedure can be followed, as described in the Background section. In one embodiment of the invention, a rectangular mail package 10 is placed halfway off the edge of a flat surface such that the length "L" is parallel to the edge of a flat surface. Using constant, steady pressure, mail package 10 is bent at a predetermined test deflection point one inch from the outer edge, in the center of its length "L". Mail package 10 is flexible, according to the standards, if it can bend at least one inch vertically without meeting a failure condition. A failure condition can include any of a variety of damage incidents including plastic deformation, breaking, tearing, creasing, bursting, shifting of article 101 more than two inches within mail package 10, and combinations thereof. Any condition as a result of flexing that does not allow the mail package to be processed by automated equipment and results in a NFM characterization, is considered a failure condition. If mail package 10 does not contain a rigid insert, no further testing is required.

In another embodiment of the invention, a rectangular mail package 10 with a length of less than ten inches, and containing a rigid insert, is placed with length "L" perpendicular to the edge of a flat surface such that about half of its length "L" extends off of the surface. A downward, steady force is applied at a predetermined test deflection point. This test point can be located, for example, at a point 1 inch from the outer edge of mail package 10, in the center of the width "W". Mail package 10 can be flexed at the test point at least one inch in a downward direction without meeting a failure condition. A failure condition can include any of a variety of damage incidents including plastic deformation, breaking, tearing, creasing, bursting, shifting of article 101 more than two inches within mail package 10, and combinations thereof. Any condition as a result of flexing that does not allow the mail package to be processed by automated equipment and results in a NFM characterization, is considered a failure condition. Mail package 10 is then turned around and the procedure is repeated. In another embodiment of the invention for a rectangular mail package 10 of ten inches or greater, mail package 10 can be flexed at a test point at least two inches, using the procedure described above, without meeting a failure condition.

In an alternative embodiment of the invention, mail package 10 meets the flexibility requirements above, yet also comprises a rebound characteristic, such that mail package 10 is flexed from an initial plane with the application of a downward force and mail package 10 rebounds within a certain percentage from the initial plane when the downward force is removed. In one embodiment of the invention, mail package 10 rebounds within 50% of the initial plane upon removal of the downward force.

To meet the U.S. uniformity standard, thickness "T" of mail package 10 cannot vary by more than from about 0.25 inch to about 0.5 inch at any point along mail package 10. In one embodiment of the invention, as depicted in FIG. 6, T has a variance of equal to or less than 0.25 inch at any point along mail package 10.

A method of distributing advertising and promotional articles to a current or prospective customer according to the present invention includes providing a carrier, securing at least one article, such as a promotional article or product sample, at a location about the carrier, optionally providing other articles such as literature, advertising materials, and the like with the carrier, packaging the carrier and other optional articles to create a uniform, flexible mail package meeting the USPS proposed uniformity and flexibility standards that can be readily processed by automated equipment.

To provide a mail package including an article, such as a promotional article or product sample, that can be readily processed by automated equipment, the article should remain stationary at a desired location and orientation within the mail package such that the mail package can be fed through the automated equipment without causing damage or destruction to the article, and/or malfunction of the automated equipment. In addition, the mail package should remain at a desired orientation within the automated equipment, without significant variation, throughout the entire processing of the mail package. The mail package should also be capable of flexing at multiple points and in multiple directions.

One method of accomplishing these characteristics can include forming a carrier of a material with flexibility characteristics, such as thickness, tensile strength, and the like, and with such dimensions, such as thickness, to provide multiple points of deflection and the capability to flex in multiple directions. In addition, retaining means can be formed at a location and orientation such that the retaining means can aid in keeping the mail package at a desired orientation throughout the automated processing of the mail package. A method of providing a mail package for automated processing includes forming a carrier from a material with desired flexibility characteristics, such as modulus of elasticity and thickness, forming the carrier with at least one retaining means for retaining an article at a location on the carrier; orientating the retaining means during forming such that the article remains stationary at a location and orientation within the mail package during automated processing, placing an article at the retaining means location on the carrier; and processing the mail package with automated equipment.

The invention may be embodied in other specific forms without departing from the essential attributes thereof; therefore, the illustrated embodiments should be considered in all respects as illustrative and not restrictive.

What is claimed is:

1. A mail flat assembly for mailing a rigid article while meeting mail flat standards for uniformity and flexibility for automated mail processing, the mail flat assembly being generally rectangular and presenting a length, a width, and a thickness, the mail flat assembly being selectively shiftable between a generally planar relaxed condition and a nonplanar stressed condition, the mail flat assembly comprising:

a tray comprising a sheet of polymeric material having structure defining:

a first walled recess extending inwardly at a depth from a first surface of the sheet to define an open first well, and at least one additional walled recess extending inwardly from the first surface of the sheet to define at least one additional well;

an article selectively retained within the first well, the article being generally rigid in at least one dimension; and a packaging assembly at least partially covering the tray to define an interior volume of the mail flat assembly, the packaging assembly having an exterior volume such that the length of the mail flat assembly is not more than fifteen inches, the width is not more than twelve inches, and the thickness is not more than three-quarters of an inch, wherein the mail flat assembly is shiftable from the relaxed condition to the stressed condition via application of a downward force when the mail flat assembly is placed on a horizontal surface in each of three configurations, a first configuration being such that the length of the mail flat assembly is perpendicular to an edge of the horizontal surface and the length extends a lesser of one-half the length or five inches beyond the edge of the horizontal surface thereby defining a first supported portion and a first extended portion, a second configuration being 90 degrees in rotation from the first configuration in a plane parallel to the horizontal surface such that the length is parallel to the horizontal surface and the width extends one-half the length beyond the edge of the horizontal surface thereby defining a second supported portion and a second extended portion, and a third configuration being 180 degrees in rotation from the first configuration in the plane parallel to the horizontal surface such that the length of the mail flat assembly is perpendicular to an edge of the horizontal surface and the length extends a lesser of one-half the length or five inches beyond the edge of the horizontal surface thereby defining a third supported portion and a third extended portion, wherein the downward force is applied to the extended portions in each of the three configurations such that the mail flat assembly is flexed at least one inch from the horizontal surface thereby defining the nonplanar stressed condition, wherein the mail flat assembly returns from the stressed condition to the relaxed condition upon removal of the downward force, and wherein a relationship between the depth of the first well and the interior volume of the mail flat assembly allows at least a portion of the article to extend outside of the first well not more than two inches when the assembly is in the stressed condition in each of the three configurations without permanently altering the article in the at least one dimension and without causing the article to be extended outside of the interior volume of the packaging assembly, and to return to the first well when the assembly is shifted from the stressed condition to the relaxed condition.

2. The mail flat assembly according to claim 1, wherein the mail flat assembly further comprises a rigid insert positioned within the interior volume of the mail flat assembly, and wherein the mail flat assembly is shiftable from the relaxed condition to the stressed condition via application of the downward force to the extended portion of the mail flat assembly when the mail flat assembly is in each of the first and third configurations, such that the mail flat assembly flexes at least one inch from the horizontal surface when the length is less than ten inches and at least two inches from the horizontal surface when the length is ten inches or greater.

3. The mail flat assembly according to claim 1, wherein a depth of each of the at least one additional wells is substantially equal to the depth of the first well such that a variance in thickness does not exceed about one quarter of an inch.

4. The mail flat assembly according to claim 1, wherein the first well presents an oblong cross section having a longitudinal axis, wherein the first well is positioned at an angle $\theta$ such that a tan $\theta$ is equal to a ratio of a y-component to an x-component, wherein the x-component is substantially parallel to the width of the tray, and the y-component is substantially parallel to the length of the tray, and wherein when $\theta$ equals about zero, the longitudinal axis of the first well is substantially parallel to the x-component, and when $\theta$ equals about ninety degrees, the longitudinal axis is substantially parallel to the y-component.

5. The mail flat assembly according to claim 1, wherein the tray further comprises bridging members connecting the at least one additional well to a second additional well, the first well, or both.

6. The mail flat assembly according to claim 1, wherein the tray comprises a polymeric material selected from the group consisting of polypropylene, polyvinylchloride, polyethylene, polystyrene, and combinations thereof.

7. The mail flat assembly according to claim 1, wherein the article is selected from the group consisting of a pen, magnet, product sample, key tag, calendar, key chain and combinations thereof.

8. The mail flat assembly according to claim 1, further comprising advertising literature, promotional literature, a rigid insert, or combinations thereof.

9. The mail flat assembly according to claim 1, wherein the packaging assembly comprises an envelope, foil, paper, cardboard, polywrap, shrinkwrap, or combinations thereof.

* * * * *

UNITED STATES PATENT AND TRADEMARK OFFICE

CERTIFICATE OF CORRECTION

PATENT NO. : 7,565,975 B2
APPLICATION NO. : 12/198789
DATED : July 28, 2009
INVENTOR(S) : Baker et al.

It is certified that error appears in the above-identified patent and that said Letters Patent is hereby corrected as shown below:

Column 7, Line 61:
Delete the first occurrence of "article 101".

Signed and Sealed this

Twenty-fourth Day of August, 2010

David J. Kappos

David J. Kappos
*Director of the United States Patent and Trademark Office*